United States Patent [19]

Loboda

[11] 4,097,021

[45] Jun. 27, 1978

[54] TIRE STUD PULLER

[76] Inventor: Walter J. Loboda, 1027 N. Lincoln, Park Ridge, Ill. 60068

[21] Appl. No.: 820,344

[22] Filed: Jul. 29, 1977

[51] Int. Cl.[2] ..... B66F 15/00

[52] U.S. Cl. ..... 254/22; 254/27

[58] Field of Search ..... 254/22, 27, 129; 81/370

[56] References Cited

U.S. PATENT DOCUMENTS

| | | | |
|---|---|---|---|
| 64,733 | 5/1867 | Allen et al. | 254/22 |
| 2,519,973 | 8/1950 | Mead | 81/37 D |
| 2,657,903 | 11/1953 | Johnson | 254/27 |
| 2,766,008 | 10/1956 | Hurd | 254/129 |

*Primary Examiner*—Robert C. Watson

*Attorney, Agent, or Firm*—Alter and Weiss

[57] ABSTRACT

A tire stud puller which includes a pivotable element for increasing the leverage of the puller when it is in operation. The pivotable element is pivotable to a position adjacent to the body of the stud puller for storage.

6 Claims, 4 Drawing Figures

TIRE STUD PULLER

BACKGROUND OF THE INVENTION

1. FIELD OF THE INVENTION

The present invention relates to tire stud pullers, and more particularly, to a tire stud puller which includes a leg for increasing the leverage thereof

2. DESCRIPTION OF THE PRIOR ART

The prior art abounds with various tools designed for pulling tire studs or the like. The advantage of including a leg which is extensive from these tools, to increase the leverage thereof when they are employed, is well known in the art. Typical are the tools disclosed in U.S. Pats. 708,841, 2,070,217, 2,870,988, and 650,186.

A primary disadvantage of all presently known tire stud pullers and similar tools is that the extensive legs thereof are not collapsible and are fixed in a position where they permanently protrude from the tool. This situation presents an inconvenience as well as a safety hazard. The inconvenience arises when these tools are stored in a tool box or the like. They require an inordinate amount of space and may frequently entangle with other tools. A safety hazard arises if one of these tools is inadvertently left in a precarious position on a shelf or if it is inadvertently placed upon a floor or the like. Accidental engagement of the tool by a casual passerby may cause serious injury since the extensive legs thereof protrude unprotected therefrom.

The present invention overcomes the problems associated with the prior art by providing a tire stud puller with an extensive leg that is pivotable into a position adjacent to the body thereof for storage.

SUMMARY OF THE INVENTION

Therefore, a primary object of the present invention is to provide a tire stud puller with pivotable leg extensive therefrom.

A further object of the present invention is to provide a tire stud puller wherein the pivotable leg thereof may be placed adjacent to the body thereof for safety reasons.

A still further object of the present invention is to provide a tire stud puller which may be compactly stored in a toolbox or the like.

Still another object of the present invention is to provide a tire stud puller which may be employed to easily and quickly remove studs from a tire.

Still another further object of the present invention is to provide a tire stud puller which is simple in design, inexpensive to manufacture, and durable.

These objects, as well as further objects and advantages, of the present invention will become readily apparent after reading the description of a non-limiting illustrative embodiment and the accompanying drawing.

A tire stud puller according to the principles of the present invention includes an elongated element terminating in a first jaw; a pivotal element terminating in a second jaw, the pivotal element pivotably affixed to the elongated element with the second jaw operably disposed adjacent to the first jaw; means for urging the second jaw adjacent to the first jaw; and a leg pivotably affixed on one end thereof to the elongated element, the leg pivotable from a storage position adjacent to the elongated element to a use position extensive therefrom and adjacent to the first jaw.

BRIEF DESCRIPTION OF THE DRAWING

In order that the present invention may be more fully understood it will now be described, by way of example, with reference to the accompanying drawing in which.

DESCRIPTION OF THE PREFERRED EMBODIMENT

Figure 1:
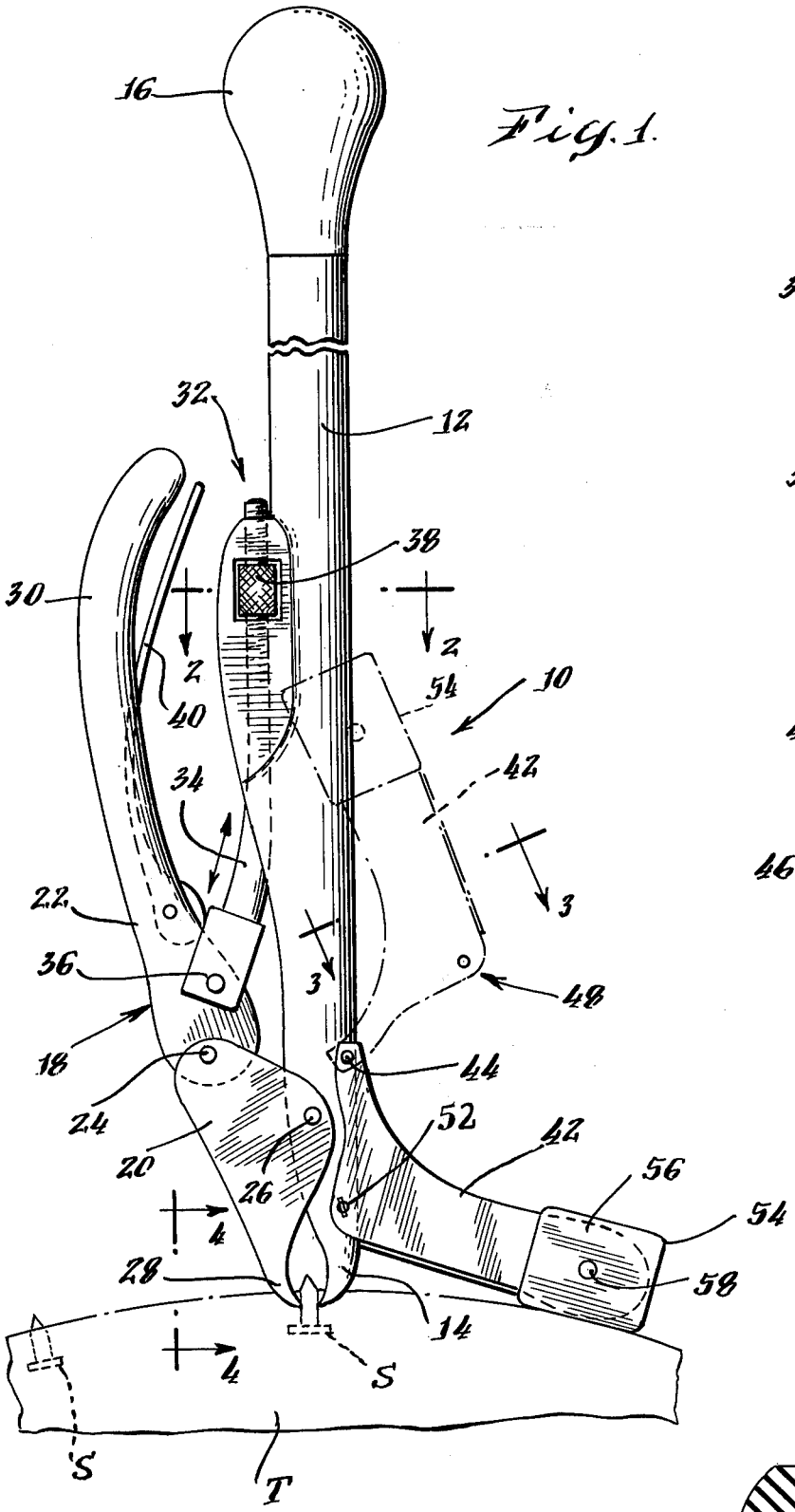
FIG. 1 is a pictorial representation of the preferred embodiment incorporating the principles of the present invention therein.

Referring now to the figures, wherein like numerals indicate like elements throughout the several views, there is illustrated therein a tire stud puller 10. The tire stud puller 10 includes an elongated element 12 which terminates in a first jaw 14 at one end thereof and is provided with a knob or handle 16 at the other end thereof. A pivotable element 18 including a first section 20 and a second section 22 joined together by a pivot 24 is pivotably affixed by a pivot 26 to the elongated element 12. The first section 20 terminates in a second jaw 28 which is operably disposed adjacent to the first jaw 14 so that the first and second jaws 14 and 28 may be pivoted together to clamp around a metal stud S.

Figure 2:
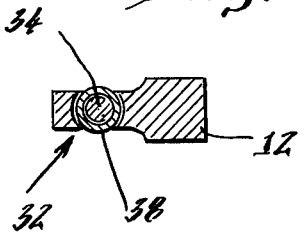
FIG. 2 is a cross-sectional view taken substantially along the lines 2—2 of FIG. 1.

When the handle portion 30 of the second section 22 is urged toward the elongated element 12, the second jaw 28 is urged towards the first jaw 14. The amount of tension placed upon the stud S depends upon the adjustment of an adjustment mechanism 32. The adjustment mechanism 32 includes a rod 34 affixed on one end thereof by a pivot 36 to the second section 22, with the other end thereof threaded and and threadably received within a rotatable threaded collar 38 rotatably mounted on the elongated element 12 as illustrated in FIG. 2. A conventional quick release lever 40 is also provided to disengage the first and second jaws 14 and 28 from the stud S as desired.

Figure 3:
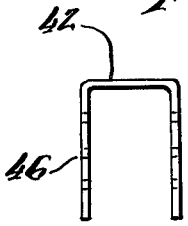
FIG. 3 is a cross-sectional view taken substantially through the lines 3—3 of FIG. 1.
Figure 4:
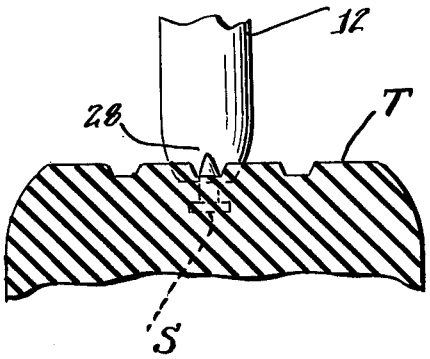
FIG. 4 is a cross-sectional view viewed from the lines 4—4 of FIG. 1.

A leg 42 is provided to increase the leverage of the tire stud puller 10 when it is employed to remove a stud S from a tire T. The leg 42 is substantially "L" shaped as illustrated and is pivotably affixed by a pivot 44 to the elongated element 12. The leg 42 forms a groove 46 therein, as illustrated in FIG. 3, so that it may be pivoted into a position illustrated by the phantom lines 48 wherein the groove 46 captures and accommodates therein a portion of the elongated element 12. When the leg 42 is pivoted into this storage position as illustrated by the phantom lines 48, it may be retained in position by a screw 58 which is received within a threaded aperture, not shown, disposed in the elongated element 12.

When the leg 42 is pivoted into a use position as illustrated in FIG. 1, it is secured in this position by a lock screw 52 which engages an aperture, not illustrated, located in the elongated element 12. The leg 42 preferably includes a stabilizing element 54 located on an end 56 thereof. The stabilizing element 54 increases the contact area of the leg 42 with the tire T and also precludes puncture or other damage thereto. The stabilizing element 54 is preferably pivotally affixed by a pivot 58 to the leg 42 so that it may adapt the contour of tire T in which studs S are removed. Furthermore, the stabilizing element 54 may be constructed of a semi-resilient material.

Therefore, a primary advantage of the present invention is to provide a tire stud puller with a pivotable leg extensive therefrom.

A further advantage of the present invention is to provide a tire stud puller wherein the pivotable leg thereof may be placed adjacent to the body thereof for safety reasons.

A still further advantage of the present invention is to provide a tire stud puller which may be compactly stored in a toolbox or the like.

Still another advantage of the present invention is to provide a tire stud puller which may be employed to easily and quickly remove studs from a tire.

Still another further advantage of the present invention is to provide a tire stud puller which is simple in design, inexpensive to manufacture, and durable.

It will be understood that various changes in the details, materials, arrangements of parts and operation conditions which have been herein described and illustrated in order to explain the nature of the invention may be made by those skilled in the art within the principles and scope of the invention.

Having thus set forth the nature of the invention, what is claimed is:

1. A tire stud puller comprising:

an elongated element terminating in a first jaw;

said first jaw substantially positioned along the longitudinal axis of said elongated element;

a pivotal element terminating in a second jaw, said pivotal element pivotably affixed to said elongated element with said second jaw operably disposed adjacent to said first saw;

means for urging said second jaw adjacent to said first jaw;

means for fixedly maintaining and locking said pivotal element in a position wherein said first and second jaws are clamped about a tire stud disposed therebetween; and a leg pivotably affixed on one end thereof to said elongated element, said leg pivotable from a storage position adjacent to said elongated element to a use position extensive therefrom and adjacent to said first jaw.

2. A tire stud puller in accordance with claim 1, further comprising means for adjusting the pressure exerted when said urging means urges said second jaw adjacent to said first jaw.

3. A tire stud puller in accordance with claim 1, wherein said leg may be selectively secured in said use and said storage positions.

4. A tire stud puller in accordance with claim 1, wherein said leg provides a groove for accommodating therein a portion of said elongated element when said leg is disposed in said storage position.

5. A tire stud puller in accordance with claim 1, wherein said leg provides a stabilizing element adjacent to the other end thereof.

6. A tire stud puller in accordance with claim 5, wherein said stabilizing element is pivotably mounted to said leg.

* * * * *